US006321773B1

(12) United States Patent
Ramsby

(10) Patent No.: US 6,321,773 B1
(45) Date of Patent: Nov. 27, 2001

(54) WATER VALVE ASSEMBLY AND WATER DRAINING METHOD

(75) Inventor: Michael L. Ramsby, Cheboygan, MI (US)

(73) Assignee: Charles J. Hire, Boca Grande, FL (US); a part interest ( * ) Notice: Subject to any disclaimer, the term of this patent is extended or adjusted under 35 U.S.C. 154(b) by 0 days.

(21) Appl. No.: 09/035,384

(22) Filed: Mar. 5, 1998

(51) Int. Cl.[7] ..... B08B 5/00; B08B 9/032; F16L 5/00; E03C 1/01; F16K 5/06

(52) U.S. Cl. ..... 137/209; 134/95.1; 134/98.1; 134/99.1; 134/166 C; 134/171; 137/240; 137/301; 137/368; 137/606; 137/625.41; 137/15.04; 251/292; 251/315.14

(58) Field of Search ..... 137/59, 61, 62, 137/79, 80, 206, 209, 240, 301, 302, 357, 364, 368, 369, 605, 606, 625.41, 15.04, 15.05, 15.06; 251/315.1, 315.11, 315.12, 315.13, 315.14, 292; 134/94.1, 95.1, 98.1, 99.1, 166 C, 171

(56) References Cited

U.S. PATENT DOCUMENTS 190,868 * 5/1877 Jarecki ..... 137/369
250,780 * 12/1881 Broughton ..... 137/368
618,753 * 1/1899 Ward et al. ..... 137/369
1,274,103 * 7/1918 Story ..... 137/240
2,176,399 * 10/1939 Garrett ..... 137/368
2,318,638 * 5/1943 Scott ..... 137/240
3,228,412 * 1/1966 Peterson et al. ..... 137/240
3,845,779 * 11/1974 Greene, Jr. ..... 137/606
4,203,460 * 5/1980 Priese ..... 251/161
4,246,926 * 1/1981 Morello ..... 137/240
4,711,264 * 12/1987 Medvid ..... 137/241
4,809,732 * 3/1989 Buehler ..... 137/209
5,085,244 * 2/1992 Funk ..... 137/240
5,161,563 * 11/1992 Thompson ..... 137/487.5
5,327,925 * 7/1994 Ortel ..... 137/368
5,433,246 * 7/1995 Horton ..... 137/209
5,441,070 * 8/1995 Thompson ..... 137/487.5
5,722,458 * 3/1998 Potter ..... 137/625.47
5,775,365 * 7/1998 Hayden et al. ..... 137/369
5,842,683 * 12/1998 Ewi ..... 137/240
5,964,238 * 10/1999 Junkin ..... 137/240
6,068,023 * 5/2000 Potter ..... 137/625.47

* cited by examiner

*Primary Examiner*—George L. Walton
(74) *Attorney, Agent, or Firm*—Lon H. Romanski

(57) ABSTRACT

An overall valving system is situated generally between a source of water and a habitable structure; a main valve is selectively openable and closable to permit and terminate flow from such source of water to the habitable structure; a conduit is provided for supplying pressurized air to an area downstream of the main valve when the main valve is closed.

13 Claims, 6 Drawing Sheets

WATER VALVE ASSEMBLY AND WATER DRAINING METHOD

FIELD OF THE INVENTION

This invention relates generally to systems, apparatus and methods for shutting the flow of water from a source, as a water well, to a building so as to preclude having the water become frozen as within supply conduits or pipes within such building during winter.

BACKGROUND OF THE INVENTION

Heretofore, it was not unusual, in generally northern climates, to close-down cottages, summer homes and summer type of businesses for the winter season. The prior art in such situations would drain whatever water was in the water supply pipes, within such structure, onto the surface of the soil surrounding the structure or actually open a valve beneath the surface of the soil as to drain the water generally into the soil substrates with such preferably being below the frost line of the soil.

It was found that such prior art produced a risk of contaminating related water tables water wells, and supplying piping as well as house plumbing.

It appears that various governmental agencies are now requiring the water from water systems of summer habitable structures to be drained in a manner preventing the drained water from in any way polluting well water and the like. In such prohibitions, the draining systems may not drain the water onto the surface of the soil or into the subsurface soil.

The invention as herein disclosed is primarily directed to the solution of the aforestated as well as other related and attendant problems of the prior art.

SUMMARY OF THE INVENTION

Method

In a water system for a habitable structure comprising first conduit means operatively communicating with a source of water, a water pressure tank assembly, wherein said first conduit means communicates with said water pressure tank assembly as to be generally upstream thereof, a sink assembly, said sink assembly comprising drain means for draining water from said sink assembly to associated drained water receiving means, second conduit means, wherein said second conduit means communicates with said water pressure tank assembly as to be generally downstream thereof, wherein said second conduit means comprises first water valve means, an additional tank for heated water, third conduit means communicating with said second conduit means and with said additional tank, fourth conduit means communicating with said additional tank for conveying water from said additional water tank to said sink assembly, wherein said sink assembly further comprises second water valve means and first faucet means, wherein said second water valve means is effective for completing or terminating communication between said fourth conduit means and said first faucet means, wherein said sink assembly further comprises third water valve means, fifth conduit means communicating with said second conduit means, wherein said third water valve means is effective for completing or terminating communication between said second conduit means and said first faucet means, fourth water valve means operatively connected to and in communication with said additional water tank, fifth water valve means operatively connected to and in communication with said water pressure tank assembly, master water valving means operatively connected to said first conduit means and to said source of water, the method of eliminating water from said water system as to thereby prevent such water from causing damage by the freezing of such water in said water system, said method comprising the steps of actuating said master water valving means to terminate the flow of water therethrough and to said first conduit means, actuating said second and third water valve means to an open condition, actuating said fourth water valve means to an open position, permitting water to gravitationally flow until such water stops flowing out of an elevationally lowest faucet, actuating said fifth water valve means to an open condition and permitting water to flow out of said fifth water valve means, applying pressurized gas to said first conduit means to thereby force water out of said first conduit means and through said fifth water valve means until substantially only said gas flows out of said fifth water valve means, actuating said first water valve means to an open condition, and actuating said second and third water valve means and said fourth and fifth water valve means to a closed condition.

Apparatus

According to the invention, a fluid valving arrangement comprises a valve assembly, wherein said valve assembly comprises a valve assembly housing, wherein said valve assembly housing comprises fluid passage means, wherein said fluid passage means comprises fluid inlet means, wherein said fluid passage means comprises fluid outlet means, a positionable valving member situated generally in said fluid passage means and positionable to a first position wherein communication between said fluid inlet means and said fluid outlet means is closed and wherein said positionable valving member is positionable to a second position wherein communication between said fluid inlet means and said fluid outlet means is established, actuating means for selectively positioning said positionable valving member to either said first position or to said second position, and additional passage means for at times applying a superatmospheric gas pressure to said positionable valving member when said valving member is in said first position.

Various objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENTS

Figure 1:
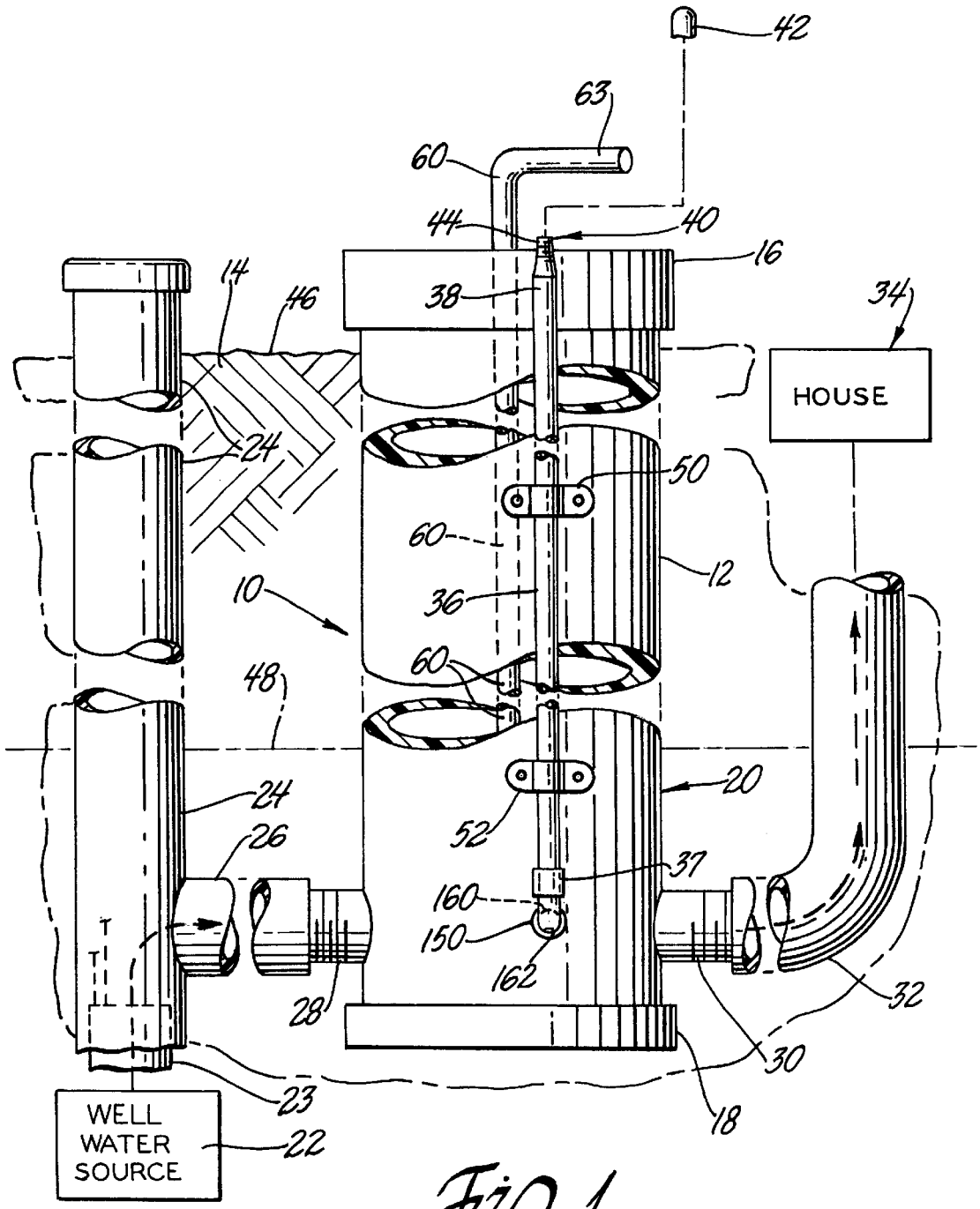
FIG. 1 is, in the main, a side elevational view of a water supply system and a water draining system, employing teachings of the invention, depicted as being situated in surrounding soil and with portions broken away and other portions being schematic designations.

Referring now in greater detail to the drawings, FIG. 1 depicts a valving assembly 10, employing teachings of the invention, as comprising a generally vertically axially extending housing or body 12 which is set as within the earth or soil 14. In the preferred embodiment, the housing 12 is of tubular cylindrical configuration provided with suitable end cap members 16 and 18. Although the housing means 20, comprising housing body 12 and end caps 16 and 18, may be formed of any suitable material, the embodiment as depicted contemplates that such housing means 20 be comprised of plastics material, as for example, polyvinyl chloride.

A source of water, such as a water well 22, communicating as with an electric pump 23 in a well casing 24 (as is known in the art) supplies water to conduit means within the casing and through conduit means 26, in turn, connected as to what may be considered inlet conduit means 28. As will be seen, conduit means 28 leads to valving means within housing means 20. Another conduit 30 may be considered an outlet conduit communicating with the same valving means and leading to a main water supply conduit 32 which is depicted as leading to a related structure or building 34 such as, for example, a house, store, business and the like. A further conduit 36 has its main length situated externally of the housing 12 and, at its lower end (as viewed in FIGS. 1 and 2), generally communicates with the same valving means as do conduits 28 and 30. The generally upper end 38 of conduit 36 is preferably provided with a valving assembly 40 which may be much like a tire air valve whereby when air, or some other appropriate gas, under positive pressure is applied to the valved end such end opens and permits the pressurized air and/or gas to flow into the tire valve or valving assembly 40 which, in his case would be conduit 36. An internally threaded closure cap 42 is effective for threadably engaging an outer threaded portion 44 of valving assembly 40 to preclude the unintentional opening of valving assembly 40 as well as preventing the introduction of foreign matter into the valving assembly 40. As is well known in the art, valving assembly 40 comprises check valve means whereby pressurized gas applied to the inlet of valve 40 causes such to become open and thereby flow such gas into and downwardly of conduit 36. When the supplying of pressurized gas to conduit 36 is terminated, the valving assembly 40 being a check valve means, prevents flow upwardly and out of the end 38 and valve assembly 40.

Conduit 36 may be supported by the housing body 12 as by brackets 50 and 52 secured to housing body 12 and effectively holding conduit 36.

As depicted, the water valving assembly 10 may be partially below the soil surface 46 as to have conduit portions 26, 28 and 30 below the frost line 48 of the earth or soil.

Figure 2:
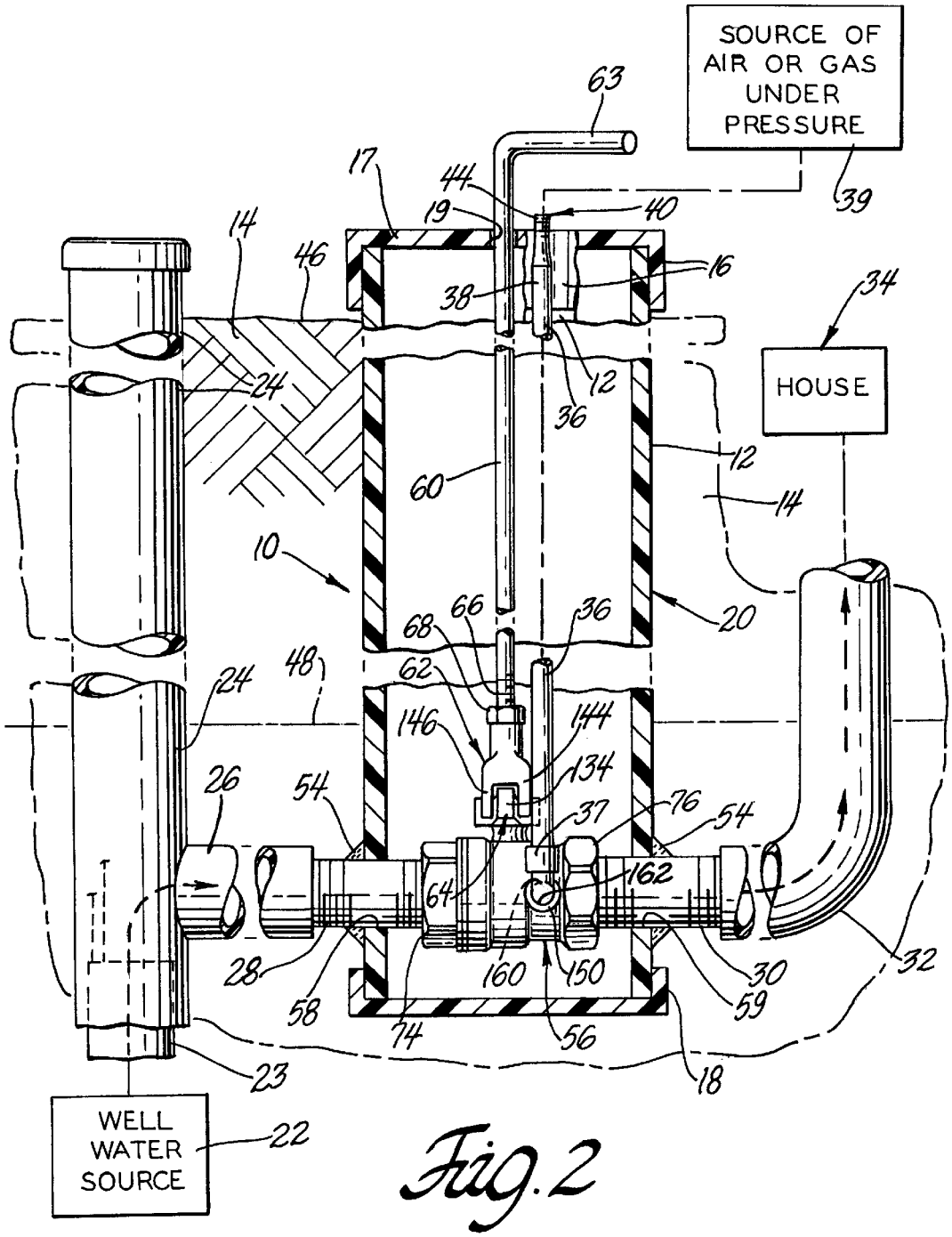
FIG. 2 is a view similar to that of FIG. 1 but showing the main housing, of the inventive valving housing, in longitudinal cross-section and internal elements in elevation.

Referring also FIG. 2, the conduits or pipes 28 and 30 are shown operatively connected to the valve assembly 56 for the selective flow of water therethrough. In the preferred embodiment, sealing and/or adhesive material 54 may be placed generally about pipes 28 and 30 and respective apertures 58 and 59 to further assure sealing therebetween.

The valve assembly 56 may be actuated to and from fully "opened" and fully "close" positions whereby flow from conduit 28 to conduit 30 is ether established or terminated. A manually rotatable rod 60, having a suitable end member 62 operatively engaging valve lever or handle means 64, extends axially of and in housing body 12.

The end member 62, as also generally depicted in FIGS. 3, 4, 5 and 9, may be internally threaded as to threadably adjustably engage an externally threaded end of rod 60 a portion of which is depicted at 66. Once the end member 62 is threadably positioned on the lower end portion of rod 60, a threaded locking nut 68 may be threadably urged against the end of member 62 as to thereby lock the member 62 in its selected position on rod 60.

Referring also to FIGS. 3, 4, 5, 6 and 7, the valve assembly 56 is depicted as comprising a housing body 72 having first and second ends 74 and 76 which respectively have inner threaded portions 78 and 80. The overall housing body 72 may be comprised of two housing body sections 82 and 84 with body section 82 provided with an external threaded portion 86 threadably engaged with an internal threaded portion 88 as to thereby be secured to housing body section 84. Generally oppositely situated annular internal walls 90 and 92, with respective openings or passages 94 and 96, define a medial-like chamber 98 therebetween.

A generally hollow spherical valving member 100 is situated in the chamber 98 and held in position as by a pair of oppositely disposed annular seals and guide members 102 and 104 each of which sealingly engages the outer spherical surface 106 of valve member 100. A passage 108 in the valve member 100 communicates, as through an aperture 110, with a passage 112 in housing section 82. Passage 108 also communicates, as through a second aperture 114, with a passage 116 in housing section 84.

A slot 118, formed in a wall of valve member 100, extends generally transversely of the plane of the drawing, and receives therein a drive tang 120. The tang 120 is operatively secured to the valve lever or handle means 64 as by a pivotal shank portion 122 which may have its upper end 124 externally threaded for operative engagement with an internally threaded portion 126 of a fastening nut 128.

Figure 3:
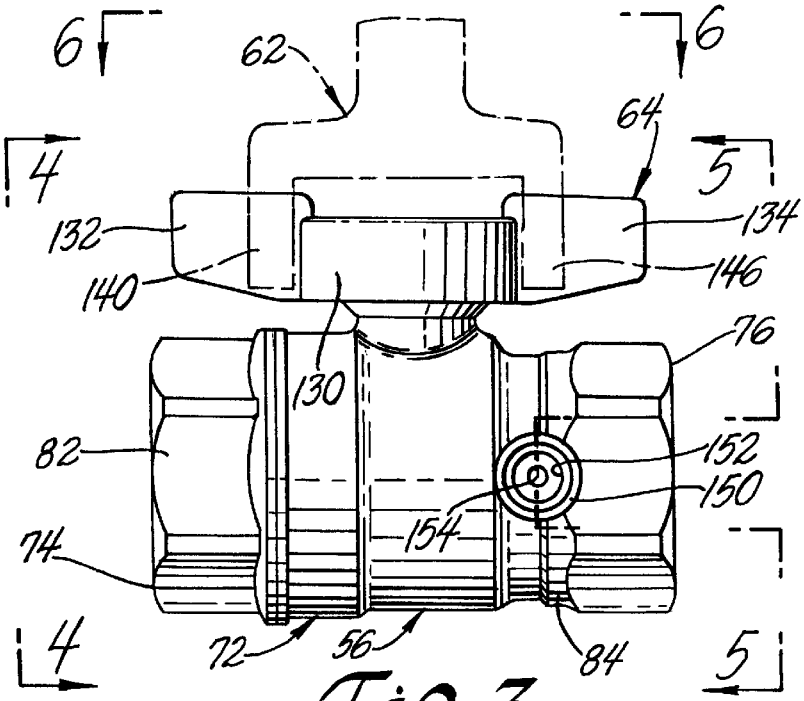
FIG. 3 is a relatively enlarged elevational view of one of the subassemblies in FIG. 2.
Figure 4:
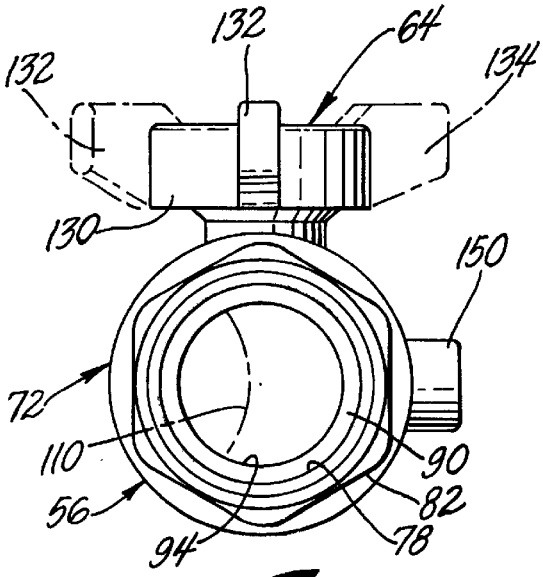
FIG. 4 is a view taken generally on the plane of line 4—4 of FIG. 3 and looking in the direction of the arrows.
Figure 9:
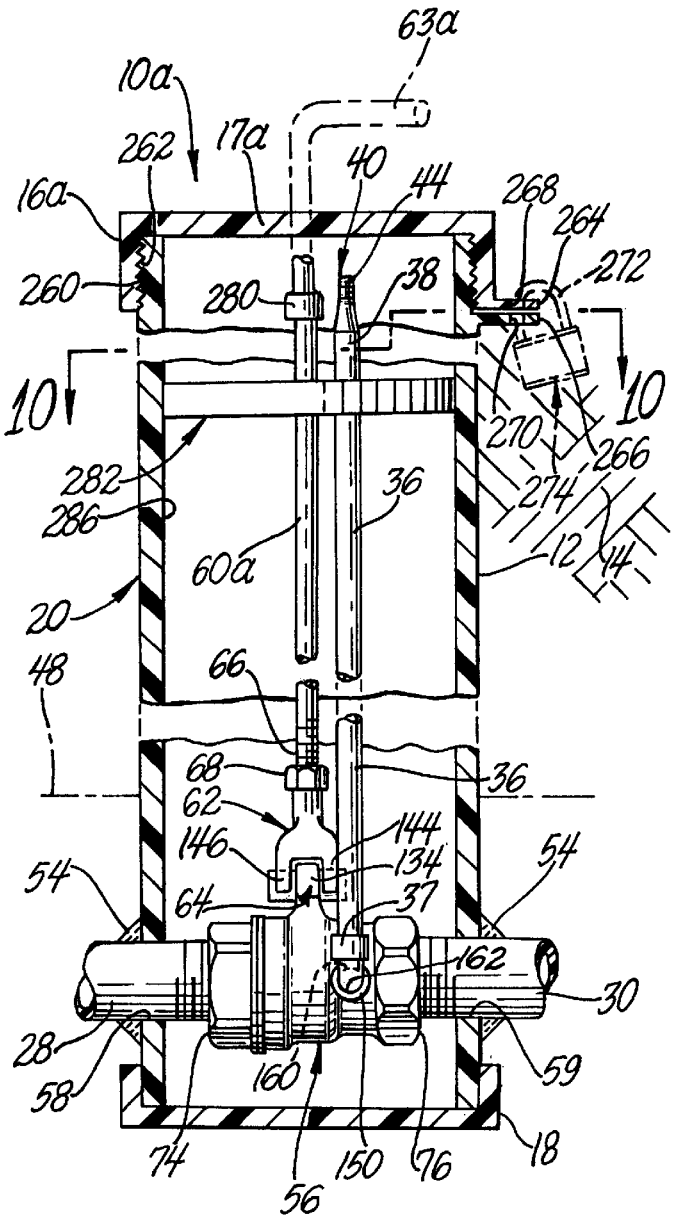
FIG. 9 is a view similar to that of FIG. 2 but illustrating another embodiment of the invention.

The valve lever or handle means 64 comprised as of a generally medial portion 130 with respective lever or wing-like portions 132 and 134 is effective, upon being rotated to the solid line positions depicted in FIGS. 3, 4, 5, 6 and 7, to fully open communication as between conduit portions 112 and 116. When the handle means 64 is rotated clockwise, from the position depicted in FIG. 6, as to be normal to the axis of flow through valving assembly 56, as depicted in FIGS. 2 and 9, the communication as between conduit or passage portions 112 and 116 is terminated. FIG. 4 depicts in phantom line the position of handle means 64 when rotated for example 45° clockwise from its solid line position in FIG. 4 as well as in FIG. 6.

As generally depicted in FIGS. 2, 3, 4, 5 and 6 an operative end member 62, carried as by the actuating rod 60, is preferably provided as with finger-like or abutment portions 140, 142, 144 and 146. As shown in FIGS. 3, 4, 5 and 6, the finger-like or drive portions 140 and 142 are situated at opposite sides of wing-like portion 132 while the finger-like or drive portions 144 and 146 are situated at opposite sides of wing-like portion 134. With the drive or coupling member 62 in the position shown in FIGS. 3, 4, 5 and 6 the valving member 100 is in its fully opened condition for flow to occur as between passages or conduits 112 and 116 as shown in FIG. 7.

Figure 5:
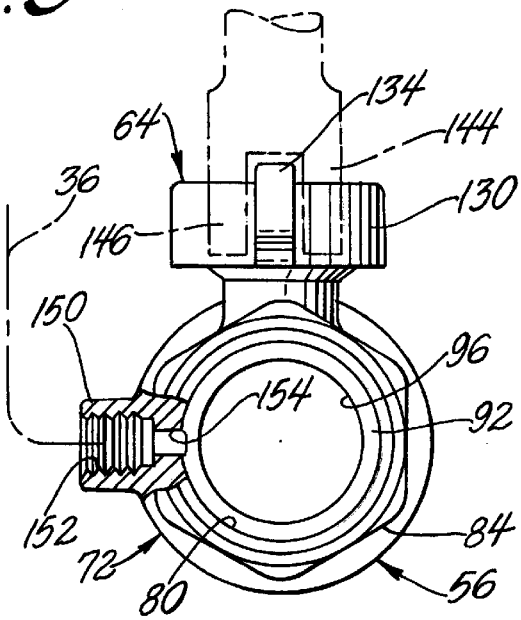
FIG. 5 is a view taken generally on the plane of line 5—5 of FIG. 3 and looking in the direction of the arrows.
Figure 6:
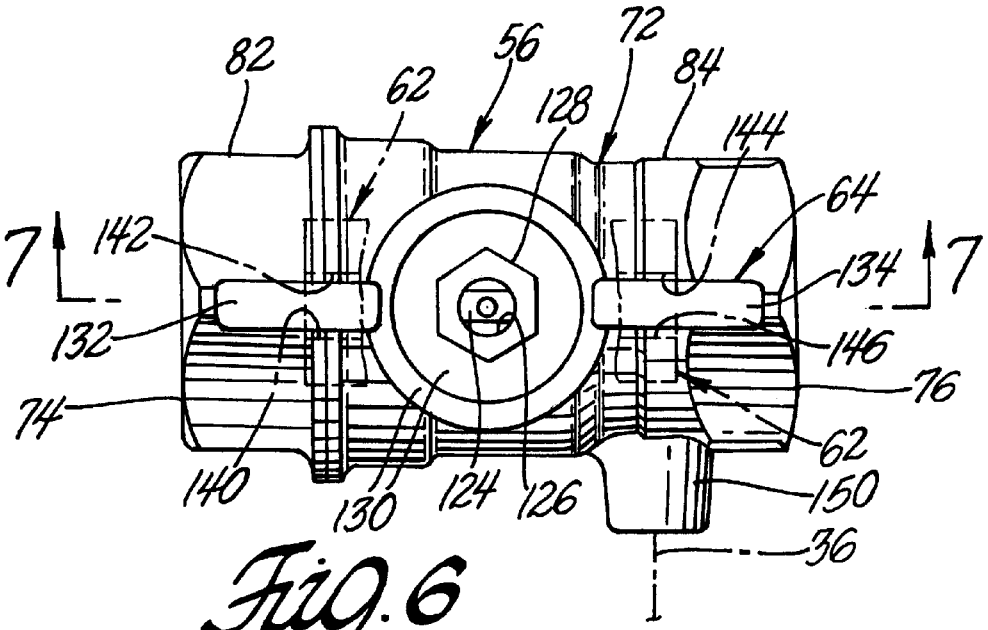
FIG. 6 is a view taken generally on the plane of line 6—6 of FIG. 3 and looking in the direction of the arrows.
Figure 7:
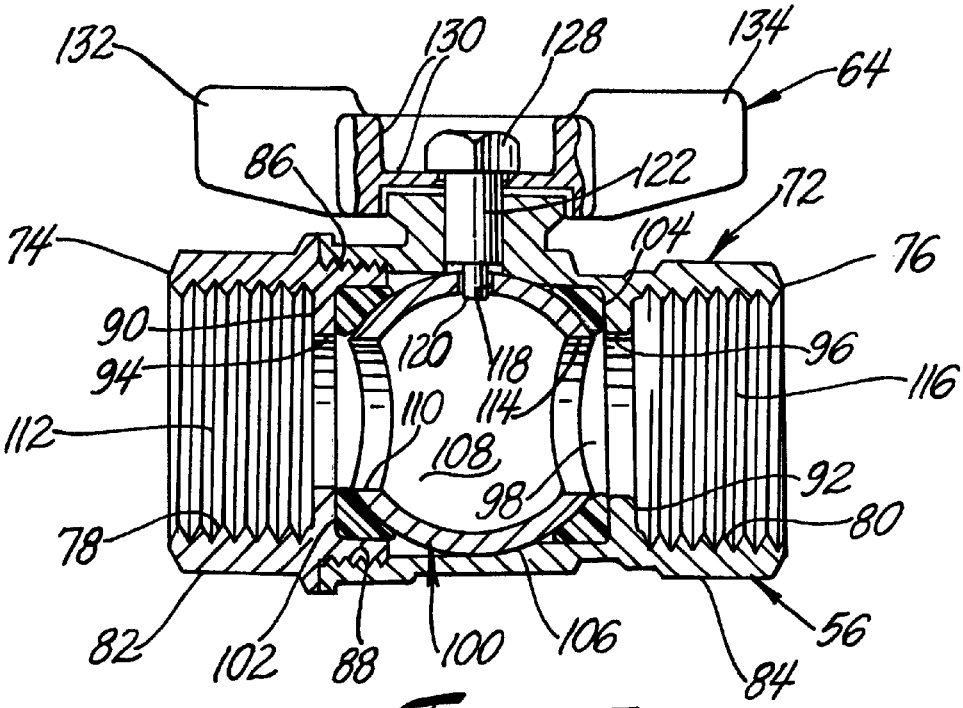
FIG. 7 is a longitudinal cross-sectional view taken generally on the plane of line 7—7 of FIG. 6 and looking in the direction of the arrows.

When the selecting or control means, comprised as of selecting or control rod 60 and coupling member 62, are rotated clockwise, as by rotation through a handle 63, from the position depicted in FIGS. 3, 5 and 6, drive portions or fingers 140 and 144 respectively abut against wing-like portions 132 and 134 and, as viewed in FIG. 6, rotate handle means 64 clockwise. As handle means 64 rotates clockwise, drive pin 122 is also rotated clockwise causing, in turn, the valve member 100 to undergo clockwise rotation through the rotating driving action of drive tang 120. FIG. 4, in phantom line depicts the position of the handle means 64 and valve opening 110 as such reach, for example, a 45° clockwise travel from the FIG. 6 position to the fully closed positions of FIGS. 6 or 9.

As shown in FIGS. 2 and 9 and as shown in relatively enlarged scale in FIGS. 3, 4, 5, 6 and 7, the valve assembly 56 is provided with an integrally formed body portion 150. An internally threaded chamber 152 communicates via passage 154 with passage 116. When he valving member 100 is in its opened condition, passage or conduit means 154 communicates as with passage or conduit 112, passages or orifices 94 and 96, valve apertures 110 and 114, valve chamber 108 and passage or conduit 116. However, when valve member 100 is in its closed position or condition, passage 154 communicates only with orifice 96 and passage 116.

As shown in FIG. 2, the lower end 160 of conduit 36 is suitably threadably secured, in sealed flow fashion, to the internally threaded portion 152 (also see FIGS. 3 and 5) of the body portion or extension 150. FIG. 1 depicts the lower end 160 passing as through suitable, and preferably sealed, aperture means 162 in outer housing 12 for communication with passages 152 and 154 (FIG. 5). For the sake of simplicity and clarity, in FIGS. 5 and 6, the conduit means 36 is represented as by the centerline 36 shown therein. It should be apparent that conduit means 36 need not be a single conduit member but may, in fact, be comprised of a plurality of conduit sections or portions. For example, the lower end 160 may be an elbow-like conduit portion passing through the housing 12, sealingly connected to the valving means 56, and threadably and sealingly connected to the vertically extending portion of conduit 36. In the preferred embodiments, second check valve means 37, many of which are well known in the art, is provided in said conduit 36 as to be in series flow relationship with conduit 36 and conduits 152 and 154. In the preferred arrangement, such check valve means 37 are situated relatively close to or even in operative engagement with passage 152.

Such additional check valve means 37 permits flow downwardly through the valve means 37 and into and through passage 152;

however, as a check valve, the valve means 37 prevents flow therethrough in the reverse direction, i.e., upwardly as depicted in FIGS. 1, 2 and 9.

OPERATION OF INVENTION APPARATUS AND METHOD

Referring to a11 of the preceding Figures and as already disclosed, when the valve member 100 is rotated to the position in FIGS. 3, 4, 5, 6 and 7, i.e., fully opened, maximum flow is permitted between conduit portions 112 and 116 through valve member 100. When handle means 64 and valve member 100 are rotated clockwise to positions depicted as in FIG. 2, the valve member 100 is rotated 90° from the position of FIGS. 6 and 7 closing communication between passages 112 and 116. When valve assembly 56 is thusly closed, passage 154 (FIGS. 3 and 5) is still in communication with passage or conduit portion 116 and, consequently, with conduits or passages 30 and 32 when assembled as depicted in FIGS. 1 and 2.

The overall apparatus or system is shown as comprising housing means 20 with valving assembly 56 therein and operatively connected to conduit means 26 and 28, which for ease may be referred to as upstream conduit means, and operatively connected to conduit means 30 and 32, which for ease may be referred to as downstream conduit means. With the valve assembly 56 being in its opened state and, for example, water pump 23 being energized, water will be pumped from water source 22, through conduit means 26 and 28, through valving member 56 and through downstream conduit means 30 and 32 to the house or other habitable structure 34.

Figure 8:
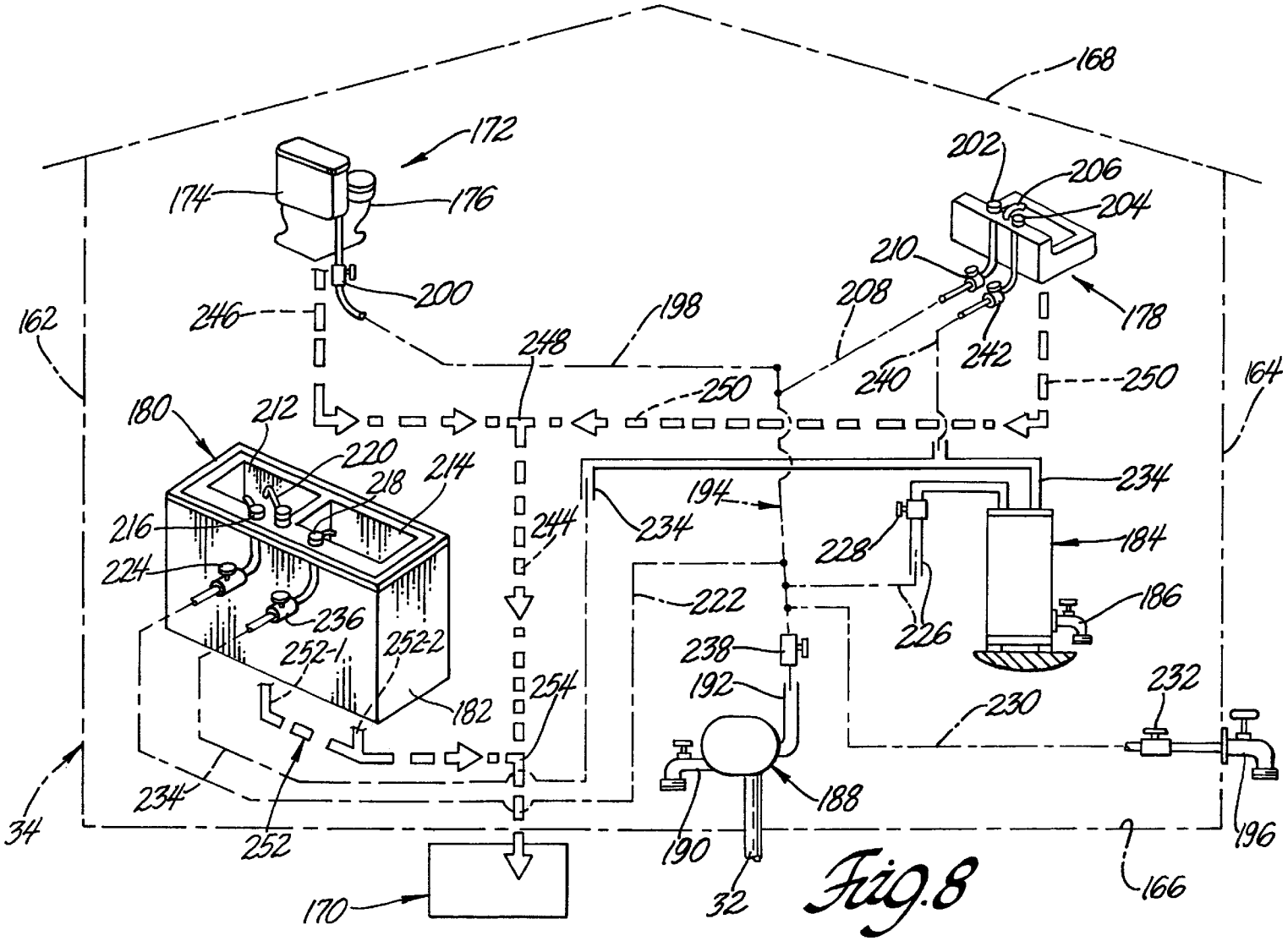
FIG. 8 is a somewhat simplified illustration of a structure containing various water employing devices and/or systems.

FIG. 8 depicts the habitable structure 34 as comprising walls 162 and 164, floor means 166 and a roof 168.

A septic system comprise s a septic tank 170 to which the drain system of the structure 34 is operatively connected.

The structure 34 may comprise: (a) a toilet assembly 172 having a water tank 174 and bowl portion 176; (b) a small sink 178; (c) a large sink 180 and cabinet structure 182; (d) a hot water tank assembly 184 with a faucet and valve assembly 186; (e) a water pressure tank 188 being supplied as by conduit means 32; (f) a faucet and valve assembly 190 communicating with the water pressure tank assembly 188; (g) a water outlet conduit 192 leading as from pressure tank assembly 188 and comprising main water distribution conduit means 194; and (h) a faucet and valve assembly 196 shown as providing for the flow of water externally of the structure 34.

A first branch conduit 198, comprising a serially situated shut-off valve assembly 200, communicates as between the water tank 174 and the unheated or cold water distribution conduit means 194. The sink 178 is shown as having manually controlled water valve assemblies 202 and 204 which, as well known in the art, functionally communicate with the sink faucet 206. A second branch conduit 208, comprising a serially situated shut-off valve assembly 210, communicates as between sink water valve 202 and the cold water distribution conduit means 194.

Sink 180 is depicted as having two sink basins 212 and 214 and manually control led water valve assemblies 216 and 218 which, as well known in the art, functionally communicate with the sink faucet 220. A third branch conduit 222, comprising a serially situated shut-off valve assembly 224, communicates as between sink water valve 216 and the cold water distribution conduit means 194.

A further branch conduit 226, comprising a serially situated shut-off valve assembly 228, communicates as between the inlet of hot water tank 184 and the cold water distribution conduit means 194. As also depicted, a branch conduit 230, comprising a serially situated shut-off valve assembly 232, communicates as between faucet and valve assembly 196 and the cold water distribution conduit means 194.

Still referring to FIG. 8, hot water is shown as being supplied by tank 184 to hot water distribution conduit means 234 which is depicted as communicating, via serially situated shut-off valve assembly 236, with sink valve assembly 218. A manually controlled water shut-off valve assembly 238, in series with conduit means 192 and distribution conduit means 194, is effective for shutting-off the supply of water as from water pressure tank 188 as to the system as generally represented in FIG. 3. A branch hot water conduit 240, comprising a serially situated hot water shut-off valve assembly 242, communicates as between hot water supply conduit means 234 and sink hot water valve assembly 204.

A main drain conduit means is depicted by the vertically extending broad segmented line at 244 leading as to the septic tank 170. A first branch-like drain conduit portion 246 leads from the toilet assembly 172 and communicates with main drain line 244 as at 248. A second branch-like drain conduit portion 250 leads from the outlet of the basin of sink 178 and also communicates with main drain line 244 as at 248.

A further branch-like drain conduit means 252, which may comprise respective drain conduit portions 252-1 and 252-2 communicating with sink basins 212 and 214, communicates with main drain line or conduit 244 as at 254.

In accordance with the invention, and by way of example, the following may be considered procedure for winterizing the water system of a house, cottage or other habitable structure.

The electrical power supply to the water pump means 23 would be terminated to da-energize pump 23. Flow through valve assembly 56 would be terminated as by turning handle 63 and rod 60 from its position as generally depicted in FIGS. 3 and 6 (wherein flow through passage 112, valving member 100 and passage 116 is permitted) to the position as generally depicted in FIG. 2 wherein flow through valving member 100 is terminated. The positioning of the handle 63, rod 60 and valving member 100 in such a non-flow condition may be considered a "closed" or "off" position or condition of the valving assembly 10. All valves and/or faucets are opened. In this description it is assumed that valves 200, 224, 236, 238, 228, 232, 210 and 242 are already open. That would mean that at this time only water valves 202 and 204 (sink 178), water valves 216 and 218 (sink 180) and valve assembly 186 (tank 184) would have to be opened. If tank 184 were to have a pressure relief valve, such, too, would be held open by suitable propping means. Water exiting valving means 186 may, of course, be directed to and through floor drain means if the structure 34 comprises such.

When water stops draining out of the elevationally lowest faucet or valve assembly, all toilet assemblies are actuated, or flushed, as to have such water as previously existed in supply tank or reservoir 174 flow from there and into the bowl 176 and into drain 246.

It should be remembered that during this time there is no flow of water through valve assembly 10 and toward the structure 34 because, as hereinbefore described, valving assembly 10 has been closed.

The valving means 190, communicating as with a lower portion of water pressure tank 188, is opened and water in such system is permitted to out-flow until all water is drained from the plumbing system. At that point, valve assembly 238 (FIG. 8) is closed.

A source 39 of air or other suitable gas under pressure is operatively connected to the inlet valving assembly 40 of conduit or passage means 36 and such fluid passes through conduit means 36, through passage or conduit means 154 and into passage 116 (such fluid is not able to flow into passage 112 because, as described, valve member 100 has been turned to closed) and from 116 through conduits 30 and 32 (FIGS. 2 and 8) to force water out of the drain means 190 as of pressure tank 188. The pressurized air, or other suitable gas, that is thusly applied to and through conduit means 36 also flows through the additional check valve means 37. The provision of such check valve means 37 prevents any water, which may be available as for example in conduit means 30, from rising in conduit 36 thereby assuming that such water would not become elevated past the related frost line 48 and thereby become frozen. When it is determined that only air (suitable fluid) is exiting valve assembly 190, the source of air or suitable gas 39 is disconnected from conduit 36 and the inlet valve means 40. At that time valve means 238 is again opened. Thereafter, inside and outside faucets as 216, 218, 190, 196, 186, 202 and 204 are closed.

Having done the above, the structure 34 is ready to be left unheated during the cold period of the year.

Assuming that the structure 34 is a vacation home or used primarily as a summer cottage, it should now be clear that the water system is made safe from damage due to freezing and still readily available if, for example, the cottage is to be used as for weekend skiing and/or other winter sports.

If the cottage 34 were to be used for winter sports and if such cottage 34 were winterized as hereinbefore described, all that would have to be done (to obtain a normal water supply) would be to turn control handle means 63 counter-clockwise, from the position shown in FIGS. 1 and 2, thereby as previously described likewise rotating valve lever means 64 counter-clockwise and causing the valving assembly 56 to assume an open to flow operating condition as depicted in FIGS. 3, 4, 5, 6 and 7 with valving member 100 becoming positioned as shown in FIG. 7. The previously terminated electrical power supply is then again energized and electrical power is applied to water pump means 23.

Consequently, the entire water system is made fully operational without any need for thawing, filling or priming. In the main, by practicing the invention, it becomes possible to enjoy an operating water supply system by easily completed steps as in the middle of winter without having to maintain heating of the cottage all the time that the cottage is unoccupied.

Figure 10:
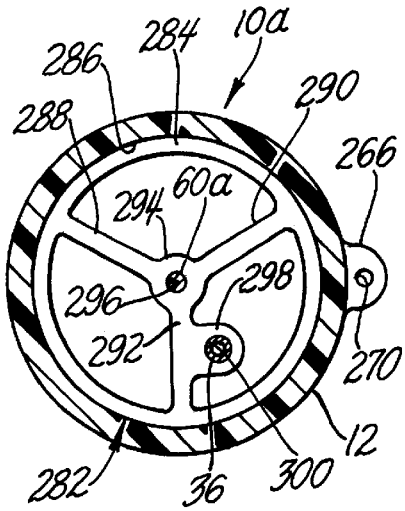
FIG. 10 is a cross-sectional view taken generally on the plane of line 10—10 of FIG. 9 and looking in the direction of the arrows.
Figure 11:
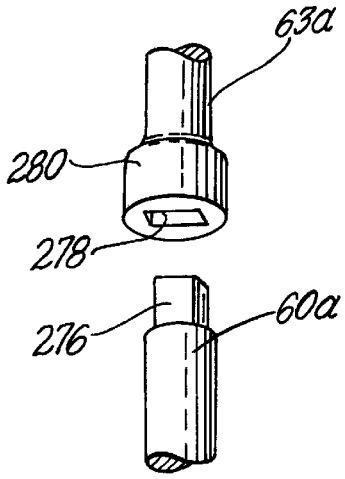
FIG. 11 is a generally perspective view, in relatively enlarged scale, of a fragmentary portion of the structure depicted in FIG. 9.

FIGS. 9, 10 and 11 depict modifications of the inventive concepts and structures herein already disclosed.

In FIGS. 9, 10 and 11 all elements which are like or similar to any of the preceding Figures are identified with like reference numbers; some of such like reference numbers are provided with a suffix "a" to more easily denote at least some elements in FIGS. 9, 10 and 11 which are not identical to those of the preceding Figures.

FIG. 9 illustrates that the end cover or cap 16*a* may be solid as across the end wall 17*a* unlike the end cover or cap 16 of FIGS. 1 and 2 wherein a suitable opening 19 is formed through the end wall 17 of the end cap or cover 16 to accommodate actuating rod 60.

In FIGS. 1 and 2 it is disclosed that the end cap or cover 16 may be assembled to the housing 12 and fixedly secured thereto as by a suitable cement or adhesive. FIG. 9 illustrates that the end cap or cover 16*a* may be detachably secured to the housing 12. For example, in the event of having a cylindrically circular housing portion as at its upper end, the housing 12 may be provided with an external threaded portion 260 which coacts with an internally threaded portion 262 formed in end cap or cover 16*a*.

FIG. 9 further illustrates that suitable locking means may be provide as to preclude the unauthorized disassembly of the end cap or cover 16*a* from the housing 12. In FIG. 9 one way of achieving such locking means is by radiating tab-like portions 264 and 266 respectively carried by end cap or cover member 16*a* and housing 12. Aligned apertures or passages 268 and 270, formed through tabs or arm portions 264 and 266, enable the shackle 272 of a lock assembly 274 to pass therethrough and effectively prevent the unauthorized removal of the end cover member 16*a* from housing 12.

In FIGS. 1 and 2 it is disclosed that the actuating rod 60 may be of unitary construction whereas FIGS. 9, 10 and 11 disclose that such a control or actuating rod 60*a* may, in fact, be comprised of a plurality of physically separate rod portions. For example, the actuating lever or handle 63*a* may be a physically separate member adapted for operative connection to the remainder of the actuating or control rod 60*a*.

Referring primarily to FIGS. 9 and 11, in the embodiment depicted, the actuating lever or handle 63*a* is physically separate from the remainder of the actuating or control rod 60*a*. As best seen in FIG. 11, the upper end of the separated control or actuating rod 60*a* may be formed as with a suitable tang portion 276 which is engageable by a complementary drive recess 278 formed in an end body portion 280 of the physically separate handle structure 63*a*. Such an arrangement could be employed as by removing the cover or end cap member 16*a* and then operatively engaging the separate handle structure 63*a* with the physically separate actuating or control rod portion 60*a* and, after thereby actuating the rod portion 60*a* to the desired position, again disengaging handle 63*a* from rod 60*a* and re-applying the end cap or cover 16*a*.

Of course, it would be possible to have formed through the end cap or cover 16*a* an access passage or aperture as to permit the introduction therethrough of the end of the control handle 63*a* to engage the upper end of rod 60*a*. In such an arrangement, the body portion 280 and drive recess means 278 could be carried by the end of the physically separate control rod 60*a*, and the shank or tang portion 276 could be carried by the lower end of control handle means 63*a*. If such an access passageway or aperture were to be employed, a lockable plug, and the like, as generally well known in the art, could be used to close the access passage or aperture and be removably locked therein.

FIGS. 9 and 10 also illustrate that means may be provided for generally locating and supporting at least one general end portion of toe actuating or control rod means 60*a*.

In FIGS. 9 and 10, the locating and supporting means 282 is depicted, by way of example, as comprising an outer circular body 284 which is received within housing 12 and suitably retained as, for example by press fit, against the inner surface 286 of housing 12. A plurality of radiating portions 288, 290 and 292 serve to interconnect and join the outer body 284 to, for example, a centrally disposed guide-like portion 294. A passageway 296, formed as through guide portion 294, slidably and guidingly receives therethrough actuator means or rod 60*a*.

Further, FIGS. 9 and 10 depict the location of the pressurizing conduit means 36 as being within the housing 12 and, preferably, supported as in and by a portion 298 carried by radiating member 292. More particularly, as depicted in FIG. 10, a passage means 300, or the like, may be formed through portion 298 so that the conduit means 36 passes therethrough and becomes supported thereby.

If end closures as at 18 are to be employed, such may be operatively secured to the housing 12 by any suitable means and, in fact, may be adhesively secured to housing 12.

Even though only preferred embodiments of the invention, and selected modifications thereof, have been disclosed and described other embodiments and modifications in practicing the invention are possible within the scope of the appended claims.

What is claimed is:

1. In a water system for a habitable structure comprising first conduit means operatively communicating with a source of water, a water pressure tank assembly, wherein said first conduit means communicates with said water pressure tank assembly as to be generally upstream thereof, a sink assembly, said sink assembly comprising drain means for draining water from said sink assembly to associated drained water receiving means, second conduit means, wherein said second conduit means communicates with said water pressure tank assembly as to be generally downstream thereof, wherein said second conduit means comprises first water valve means, an additional tank for heated water, third conduit means communicating with said second conduit means and with said additional tank, fourth conduit means communicating with said additional tank for conveying water from said additional water tank to said sink assembly, wherein said sink assembly further comprises second water valve means and first faucet means, wherein said second water valve means is effective for completing or terminating communication between said fourth conduit means and said first faucet means, wherein said sink assembly further comprises third water valve means, fifth conduit means communicating with said second conduit means, wherein said third water valve means is effective for completing or terminating communication between said second conduit means and said first faucet means, fourth water valve means operatively connected to and in communication with said additional water tank, fifth water valve means operatively connected to and in communication with said water pressure tank assembly, master water valving means operatively connected to said first conduit means and to said source of water, wherein said master valving means comprises a master valve member situated in said first conduit means and selectively movable to first and second positions for respectively permitting and terminating water flow therepast through said first conduit means, the method of eliminating water from said water system as to thereby prevent such water from causing damage by the freezing of such water in said water system, said method comprising the steps of actuating said master valve member of said master water valving means to terminate the flow of water therethrough and to said first conduit means, actuating said second and third water valve means to an open condition, actuating said fourth water valve means to an open position, permitting water to gravitationally flow until such water stops flowing out of an elevationally lowest faucet, actuating said fifth water valve means to an open condition and permitting water to flow out of said fifth water valve means, after actuating said master valve member of said master water valving means to terminate the flow of water therepast then applying pressurized gas to said first conduit means downstream of said master valve member to thereby force the water which is downstream of said master valve member out of said first conduit means and through said fifth water valve means until substantially only said gas flows out of said fifth water valve means, actuating said first water valve means to an open condition, and actuating said second and third water valve means and said fourth and fifth water valve means to a closed condition.

2. A fluid valving arrangement, comprising a valve assembly, wherein said valve assembly comprises a valve assembly housing, wherein said valve assembly housing comprises fluid passage means, wherein said fluid passage means comprises fluid inlet means, wherein said fluid passage means comprises fluid outlet means, a positionable valving member situated generally in said fluid passage means and positionable to a first position wherein communication between said fluid inlet means and said fluid outlet means is closed and wherein said positionable valving member is positionable to a second position wherein communication between said fluid inlet means and said fluid outlet means is established, actuating means for selectively positioning said positionable valving member to either said first position or to said second position, wherein said valving member when moved from said first to said second position and from said second position to said first position defines an axis of rotation, wherein said valve member when moved from said first position to said second position and from said second position to said first position experiences angular rotation about said axis of rotation without attendant axial movement along said axis of rotation, additional passage means formed at least partly in said valve assembly housing for at times applying a superatmospheric gas pressure to purge the downstream side of said positionable valving member when said valving member is in said first position, wherein said additional passage means comprises conduit means having a first end for communication with said fluid outlet means downstream of said positionable valving member, and wherein said conduit means extends generally parallel to said axis of rotation and away from said valve assembly housing.

3. A fluid valving arrangement according to claim 2, and further comprising protective housing means effectively containing and protecting said valve assembly housing, said protective housing means comprising housing wall means, and wherein said housing wall means extends longitudinally generally parallel to said axis of rotation and away from said valve assembly housing.

4. A fluid valving arrangement according to claim 2, wherein said actuating means comprises longitudinally extending rod-like means extending generally parallel to said axis of rotation, wherein said rod-like means is manually selectively rotatable generally about said axis of rotation for thereby rotatably positioning said rotatably positionable valving member into said first position or said second position, and wherein said rod-like means is selectively disengagable from operative connection to said rotatably positionable valving member.

5. A fluid valving arrangement according to claim 3, wherein said additional passage means comprises conduit means having a first end in communication with said fluid outlet means, wherein said conduit means extends longitudinally generally parallel to said axis of rotation and away from said valve assembly housing, and wherein said longitudinally extending conduit means is inwardly of said housing wall means.

6. A fluid valving arrangement according to claim 3, wherein said additional passage means comprises conduit means having a first end in communication with said fluid outlet means, wherein said conduit means extends longitudinally generally parallel to said axis of rotation and away from said valve assembly housing, and wherein said longitudinally extending conduit means is outwardly of said housing wall means.

7. A fluid valving arrangement according to claim 4, and further comprising protective housing means effectively containing and protecting said valve assembly housing, said protective housing means comprising housing wall means, wherein said housing wall means extends longitudinally generally parallel to and about said axis of rotation and away from said valve assembly housing, and wherein said longitudinally extending rod-like means is situated inwardly of said housing wall means.

8. A fluid valving arrangement according to claim 2, wherein said additional passage means comprises first fluid check valve means and second fluid check valve means.

9. A fluid valving arrangement according to claim 4, wherein said rod-like means comprises a plurality of rod-like sections selectively joinable to each other.

10. A fluid valving arrangement according to claim 2, and further comprising protective housing means effectively containing and protecting said valve assembly housing, said protective housing mean comprising housing wall means, said housing wall means comprising aperture means, wherein said fluid inlet means and said fluid outlet means extend through said aperture means, wherein said housing wall means extends longitudinally away from said valve assembly housing, wherein said additional passage means comprises conduit means having a first end in communication with said fluid outlet means, wherein said conduit means extends upwardly from said valve assembly housing, wherein said actuating means comprises longitudinally extending rod-like means, wherein said rod-like means is manually selectively rotatable for thereby positioning said positionable valving member into either said first position or said second position, and support means carried inwardly of said housing wall means for supporting said rod-like means and said conduit means.

11. A fluid valving arrangement, comprising a valve assembly, wherein said valve assembly comprises a valve assembly housing, wherein said valve assembly housing comprises an inlet end and an outlet end, a fluid flow passage formed through said valve assembly housing for providing communication from said inlet end to said outlet end, a valve body situated in said fluid flow passage generally between said inlet end and said outlet end, said valve body being movable to and from first and second positions for respectively closing and opening said communication through said fluid flow passage, wherein said valve body when moved from said first position to said second position and from said second position to said first position defines an axis of rotation, wherein said valve body when moved from said first position to said second position and from said second position to said first position experiences angular rotation about said axis of rotation without attendant axial movement along said axis of rotation, actuating means for selectively moving said valve body to either said first position or to said second position, wherein said outlet end is downstream of said valve body, additional passage means formed in said valve assembly housing for at times applying a flow of a superatmospheric gas to purge said fluid flow passage downstream of said valve body, and further comprising conduit means having a first end in communication with said additional passage means, wherein at least a major portion of said conduit means extends generally parallel to said axis of rotation, wherein said conduit means extends from said valve assembly housing and fluid flow passage and terminates in a second end, and check valve means in fluid communication with said conduit means and situated closer to said first end than to said second end.

12. A fluid valving arrangement according to claim 11 and further comprising, second check valve means in fluid communication with said conduit means, and wherein said second check valve means is situated closer to said second end than to said first end of said conduit means.

13. A fluid valving arrangement according to claim 11 and further comprising, conduit means having a first end in communication with said additional passage means, wherein at least a major portion of said conduit means extends generally parallel to said axis of rotation, wherein said conduit means extends from said valve assembly housing and fluid flow passage and terminates in a second end, and check valve means in fluid communication with said conduit means and situated closer to said second end than to said first end.

* * * * *

UNITED STATES PATENT AND TRADEMARK OFFICE

CERTIFICATE OF CORRECTION

PATENT NO. : 6,321,773 B1
DATED : November 27, 2001
INVENTOR(S) : Michael L. Ramsby It is certified that error appears in the above-identified patent and that said Letters Patent is hereby corrected as shown below:

Title page,
Item [56], References Cited, U.S. PATENT DOCUMENTS, add:

| | | | |
|---|---|---|---|
| -- 138,562 | 5/1873 | Hayes | 137/297 |
| 649,159 | 5/1900 | Carroll | 137/301 |
| 828,597 | 8/1906 | Cowles | 137/301 |
| 3,283,776 | 11/1966 | Flanagan et al | 137/301 |
| 3,566,905 | 3/1971 | Noland | 137/209 --. |

Immediately after "5,433,246" delete the "*".

Column 3,
Lines 44 and 45, after "tire" and before "which," delete "valve or valving assembly 40".

Column 5,
Line 24, cancel "he" and substitute therefor -- the --.

Column 7,
Line 13, cancel "FIG. 3" and substitute therefor -- FIG. 8 --.

Column 8,
Line 21, cancel "assuming" and substitute therefor -- assuring --.

Signed and Sealed this

Fourth Day of November, 2003

JAMES E. ROGAN
*Director of the United States Patent and Trademark Office*